US011434114B1

(12) United States Patent
Graham et al.

(10) Patent No.: US 11,434,114 B1
(45) Date of Patent: Sep. 6, 2022

(54) WINCH LINE TENSION MEASUREMENT SYSTEM

(71) Applicant: Altec Industries, Inc., Birmingham, AL (US)

(72) Inventors: Brian R. Graham, Saint Joseph, MO (US); William Naber, Saint Joseph, MO (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 17/554,135

(22) Filed: Dec. 17, 2021

(51) Int. Cl.
*B66D 1/50* (2006.01)
*B66C 23/90* (2006.01)

(52) U.S. Cl.
CPC ..... *B66D 1/505* (2013.01); *B66C 23/90* (2013.01)

(58) Field of Classification Search
CPC ..... B66D 1/485; B66D 1/50; B66D 1/505; B66D 3/24; B66D 5/26; B66C 15/065; B66C 23/905
See application file for complete search history.

(56) References Cited

U.S. PATENT DOCUMENTS 3,668,878 A * 6/1972 Jones ..... B63B 35/03 701/530
3,780,989 A * 12/1973 Peterson ..... B63B 21/56 254/273
6,439,341 B1 8/2002 Engvall et al.
8,613,426 B1 12/2013 Holland et al.
9,573,797 B1 2/2017 Beck
9,873,602 B2 1/2018 Beck
2009/0127525 A1* 5/2009 Teurlay ..... B66D 1/505 254/274
2010/0044332 A1 2/2010 Cameron
2015/0273253 A1 10/2015 Lenz, Jr. et al.
2015/0300906 A1 10/2015 Claxton
2016/0060083 A1* 3/2016 Klinke ..... B66D 1/505 414/800
2019/0203575 A1 6/2019 Schlosser
2020/0190769 A1 6/2020 Hand et al.
2021/0262303 A1* 8/2021 Venna ..... E21B 47/12

FOREIGN PATENT DOCUMENTS

CN 106438180 A * 2/2017 ..... F03B 13/14
JP H09112178 A * 4/1997
KR 101911526 B1 * 10/2018
WO WO-2018026744 A1 * 2/2018 ..... B66D 1/505

* cited by examiner

*Primary Examiner* — Emmanuel M Marcelo
(74) *Attorney, Agent, or Firm* — Erise IP, P.A.

(57) ABSTRACT

Systems and methods for measuring and regulating winch line pull for winches are disclosed. A tension measuring system may be mounted to a winch mounting bracket for measuring tension in the winch line during use. The tension measuring system may comprise at least one load cell for measuring the tension in the winch line. A control system may receive a measured tension value for the winch line, compare the measured tension value to a target tension value, and consequently adjust the motor. The control system may be configured to hold the winch line at a substantially constant tension. The measured tension values may be logged and graphically displayed.

20 Claims, 9 Drawing Sheets

WINCH LINE TENSION MEASUREMENT SYSTEM

BACKGROUND

1. Field

Embodiments of the invention relate to winch line tension measurement systems. More specifically, embodiments of the invention relate to control systems for measuring the actual tension in a winch line and regulating the tension in the winch line.

2. Related Art

Typically, winches are configured such that the maximum pressure allowed to drive a winch motor is controlled with a relief valve. This configuration provides consistent maximum torque but leads to varying line tension and line speed based on how full the winch drum is. Inconsistencies in the line tension during operation leads to various issues in winches. Pulling at the maximum torque on a bare drum may lead to tension safety factors that fall below acceptable levels, increasing the likelihood of equipment damage and malfunction. Winch systems are often used in overhead and underground pulling operations to install conductors or other cable. Overpulling on a line may damage the cable and lead to poor cable performance when operational. Consequently, operators have traditionally been relied upon to not enact a max pull on a less than full drum. Additionally, traditional winch systems provide no method for measuring the actual tension in a winch line and instead rely upon calculations to estimate the tension in the winch line.

Traction winches are winch systems that provide constant line tension but have features that often lead to winch damage and winch line damage. Traction winches are prone to going out of hydraulic adjustment due to factors such as varying ambient temperature, varying hydraulic oil temperature, and variances due to manufacturing tolerances. The unreliability of traction winches has caused some manufacturers to discontinue selling traction winches. Furthermore, traction winches are typically configured to handle substantially large loads (e.g., greater than 20,000 pounds) and, as such, are unsuitable for pulling smaller loads.

Further, winch systems on booms often have varying maximum lift capacities based on the position of the boom. Operators are typically relied upon to read a boom load chart to ensure the boom is not overloaded at the respective boom position. There is currently no physical mechanism for limiting the winch pull based on the boom position. Operator error in reading the boom load chart may lead to boom damage and operator injury.

What is needed are systems and methods that can monitor the actual line pull of a winch in order to provide a consistent line tension throughout an entire pull. It would be further advantageous to allow a desired maximum tension to be set to reduce reliance upon an operator thereby ensuring the winch is not over-tensioned during the pull. Furthermore, what is needed are systems and methods that can regulate winch pull to provide a substantially constant pull for substantially all load sizes. Further still, what is needed are systems and methods that provide constant tension pulls based on a boom position.

SUMMARY

Embodiments of the invention solve the above-mentioned problems by providing systems and methods for measuring and regulating line tension in a winch line on a winch. Load cells may be configured to measure the actual tension in the winch line. The load cells may be mounted to a winch mounting bracket, which holds the winch drum. The winch mounting bracket may be disposed between the winch and supporting structure for the winch. Based on the tension readings, the pressure sent to a winch motor may be varied. By varying the pressure, the torque may be adjusted. Adjusting the torque as the radius of the winch drum changes may allow for a substantially constant winch tension to be achieved. In some embodiments, an operator may define a maximum tension limit for the system.

In some aspects, the techniques described herein relate to a method for measuring winch line pull tension for a winch system including: providing a winch line on a winch drum; receiving a target line tension value for the winch line; receiving a first tension measurement value of the winch line from a first load cell; receiving a second tension measurement value of the winch line from a second load cell; determining a hydraulic pressure adjustment based on the first tension measurement value, the second tension measurement value, and the target line tension value; and responsive to determining the hydraulic pressure adjustment, adjusting a hydraulic pressure for a hydraulic winch motor to adjust a line tension of the winch line.

In some aspects, the techniques described herein relate to a method, wherein the method further includes: mounting the first load cell and the second load cell on a winch mounting bracket.

In some aspects, the techniques described herein relate to a method, wherein the method further includes displaying the first tension measurement value, the second tension measurement value, or both on a graphical display.

In some aspects, the techniques described herein relate to a method, wherein the winch line and the winch drum are disposed on a boom assembly, and wherein the method further includes: detecting a boom position, the boom position based on a boom angle, a boom extension length, or both; and determining a maximum line tension value based on the boom position.

In some aspects, the techniques described herein relate to a method, wherein the method further includes: responsive to determining the winch line cannot operate at the maximum line tension value based on the boom position, activating an alarm.

In some aspects, the techniques described herein relate to a method, wherein the method further includes: responsive to determining the winch line cannot operate at the maximum line tension value based on the boom position, preventing operation of the hydraulic winch motor.

In some aspects, the techniques described herein relate to a method, wherein the method further includes: detecting a change in the boom position; and responsive to detecting the change in the boom position, adjusting the maximum line tension value based on the change in the boom position.

In some aspects, the techniques described herein relate to a system for measuring winch line pull tension including: a winch system including at least one winch drum for storing a winch line thereon; a hydraulic motor for powering the winch system; a mounting bracket disposed between the winch system and a supporting structure for the winch system; and at least one tension measuring system on the mounting bracket, wherein the at least one tension measuring system is configured to deform during a winch line pull, wherein the at least one tension measuring system includes at least one load cell configured to measure a line tension value in the winch line during use.

In some aspects, the techniques described herein relate to a system, wherein the system further includes: one or more non-transitory computer-readable media storing computer-executable instructions that, when executed by a processor, perform a method for regulating winch line pull tension, including: receiving the line tension value from the at least one tension measuring system; comparing the line tension value to a target line tension value; and based on the comparing, adjusting a hydraulic pressure for the hydraulic motor to adjust the line tension on the winch line during use.

In some aspects, the techniques described herein relate to a system, wherein the system further includes a display, and wherein the method further includes: responsive to receiving the line tension value, displaying the line tension value on the display.

In some aspects, the techniques described herein relate to a system, wherein the winch system is disposed on a distal end of a boom, and wherein the method further includes: determining the target line tension value based on a lift capacity of the boom, wherein the lift capacity is based in part on a boom angle and a boom extension length.

In some aspects, the techniques described herein relate to a system, wherein the system further includes: an alarm, wherein the alarm is configured to be activated when the measured line tension value is above the target line tension value.

In some aspects, the techniques described herein relate to a system, wherein the winch system is disposed on a drum puller, and wherein the supporting structure includes a frame of the drum puller.

In some aspects, the techniques described herein relate to a system, wherein the at least one winch drum includes: a first winch drum and a second winch drum; and the at least one tension measuring system includes a first tension measuring system associated with the first winch drum and a second tension measuring system associated with the second winch drum.

In some aspects, the techniques described herein relate to a system for measuring winch line pull tension including: a winch system, including: a winch line and a winch drum for storing the winch line thereon; a motor for powering the winch system; a tension measuring system operably connected to the winch system; and one or more non-transitory computer-readable media storing computer-executable instructions that, when executed by a processor, perform a method for regulating winch pull tension including: determining a target tension value for the winch line; receiving a tension measurement value indicative of a tension in the winch line from the tension measuring system; comparing the tension measurement value to the target tension value; and based on the comparing, adjusting the motor to regulate the tension in the winch line.

In some aspects, the techniques described herein relate to a system, wherein the system further includes a database, and wherein the method further includes: responsive to receiving the tension measurement value from the tension measuring system, logging the tension measurement value in the database.

In some aspects, the techniques described herein relate to a system, wherein the system further includes a mounting bracket disposed between the winch system and a supporting structure for the winch system, wherein the tension measuring system is on the mounting bracket.

In some aspects, the techniques described herein relate to a system, wherein the supporting structure for the winch system is disposed on a digger derrick or a drum puller.

In some aspects, the techniques described herein relate to a system, wherein the tension measuring system includes a pair of load cells.

In some aspects, the techniques described herein relate to a system, wherein the method further includes: if the tension measurement value exceeds the target tension value, disabling the motor.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
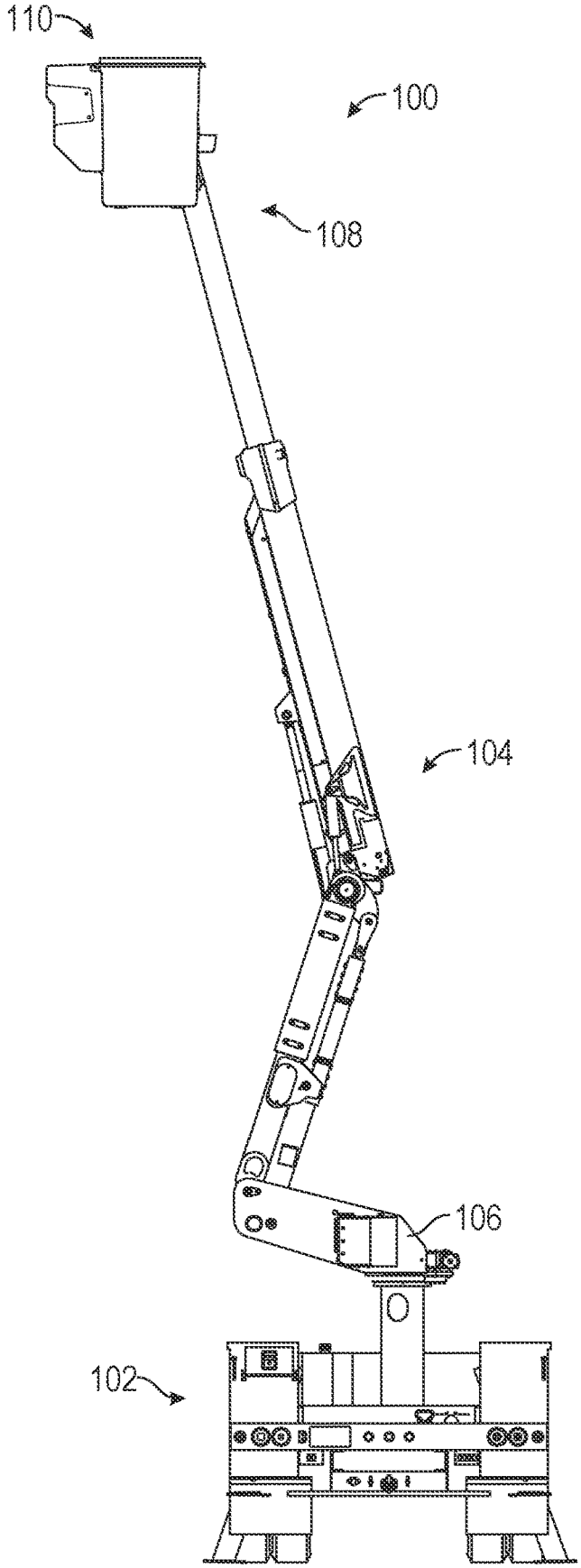
FIG. 1 depicts an aerial device for some embodiments.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized, and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Generally, embodiments of the current disclosure relate to systems and methods for directly measuring the tension in a winch line and using the tension measurement to regulate the line tension in the winch line. A tension measuring system may be operably connected to a winch line via a winch mounting bracket. The tension measuring system may comprise at least one load cell. In some embodiments, the tension measuring system is disposed between supporting structure for the winch and the winch system itself. For a machine having more than one winch system thereon, each winch system may be connected to a separate tension measuring system. The tension measuring system may be used in conjunction with winch systems on various machines, such as on a crane, a boom, a drum puller, a digger derrick, a truck, or the like. Consequently, components of the tension measuring system may comprise various sizes according to the machine and the expected tension experienced by the winch line.

A control system may utilize the tension readings from the tension measuring system to adjust the tension in the winch line. The control system may be operably connected to a winch motor and configured to adjust a hydraulic pressure sent thereto such that the torque delivered to the winch is varied as the winch line is payed-in and payed-out. In some embodiments, an operator may set a maximum winch tension for the control system to adhere to. In some embodiments, the maximum winch tension may be determined by an operational position of the winch system.

Turning first to FIG. 1, aerial device 100 for some embodiments of the invention is depicted. Aerial device 100 may be attached to utility vehicle 102, as shown. In some embodiments, aerial device 100 comprises boom assembly 104, upper boom section 108, and utility platform 110. Additionally, aerial device 100 comprises turntable 106 disposed on utility vehicle 102, as shown. As aerial device 100 may be operated near electrically powered high-voltage cables, in some embodiments, utility platform 110 and boom assembly 104 comprise insulating material for insulating aerial device 100. Furthermore, any electrical components disposed in the utility platform and on boom assembly 104 may be self-contained and separate from the electrical components of utility vehicle 102. As such, a dielectric gap is created between utility platform 110 and utility vehicle 102. In some embodiments, utility vehicle 102 may generally be referred to as a base, and may be any of a vehicle, a crane, a platform, a truck bed, a mechanical tree trimming apparatus, a hydraulic lift, or any other base capable of supporting boom assembly 104 and utility platform 110.

In some embodiments, an operator may be positioned in utility platform 110 for performing work on or near high-voltage power lines. The operator may access upper controls disposed on utility platform 110 as well as hydraulic tools for performing the work. In some embodiments, the operator in utility platform 110 may move to various positions using the upper controls. Furthermore, lower controls may be utilized at the base of aerial device 100 such as at utility vehicle 102 and at turntable 106.

Aerial device 100 and other machinery described in embodiments herein may utilize a Load Moment and Area Protection (LMAP) system. The LMAP system may communicate with aerial device 100 and display a state thereof by interpreting on-board sensor information. The LMAP system may be used to communicate with aerial device 100 to change modes that allow remote control of aerial device 100. In some embodiments, the LMAP system may be integrated with a graphical display configured to display a position of boom assembly 104, as discussed further below. In some embodiments, the LMAP system may receive a signal indicative of the measured tension in the winch line.

Figure 2A:
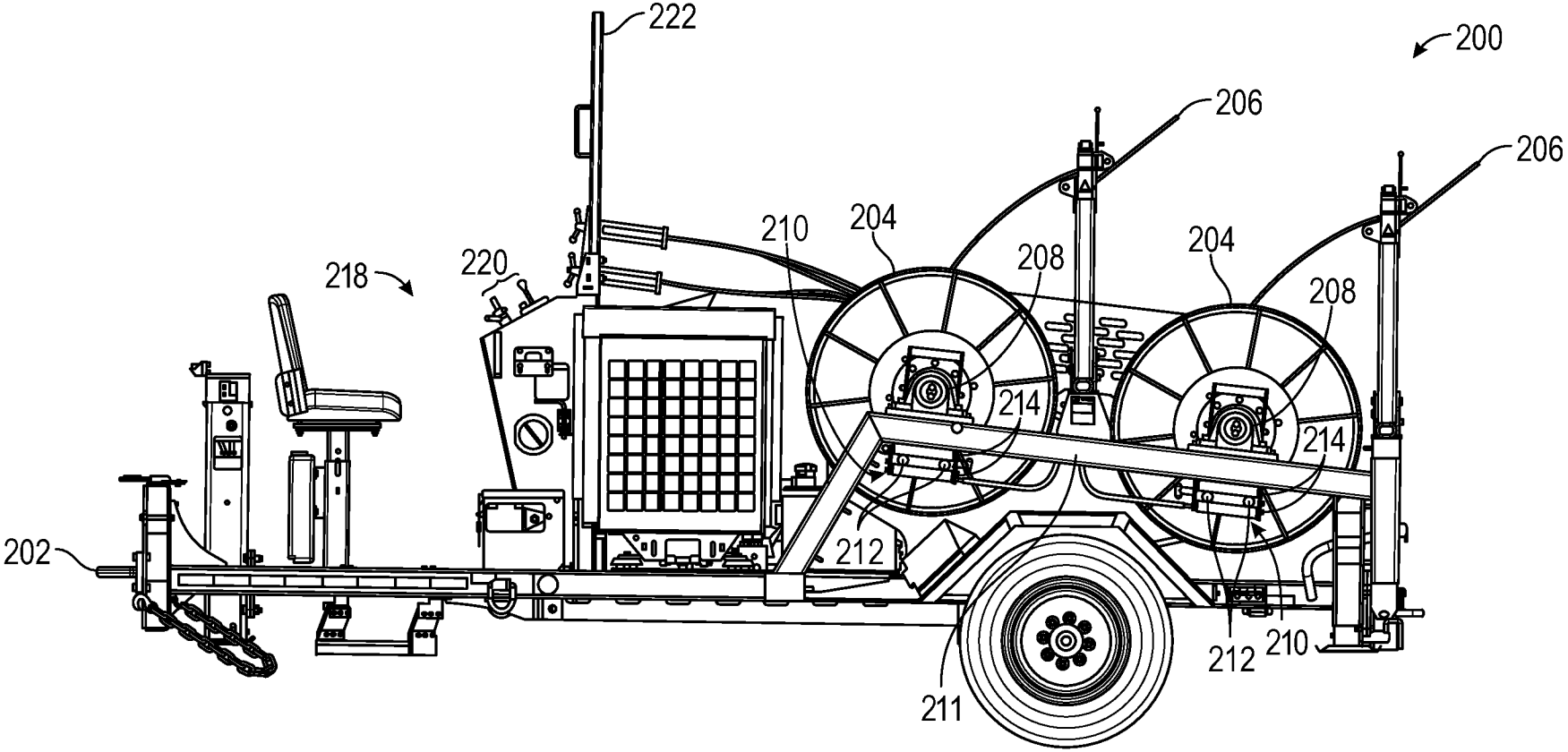
FIG. 2A depicts a drum puller having a tension measuring system thereon for some embodiments.

Turning now to FIG. 2A, a planar view of a drum puller 200 is illustrated for some embodiments. Drum puller 200 may be a trailer system configured to attach to a separate vehicle, such as a utility vehicle or a truck. In some embodiments, drum puller 200 comprises a connector 202 (e.g., trailer hitch) for connecting to the separate vehicle. Drum puller 200 may comprise a plurality of drums 204. In some embodiments, drums 204 are winch drums configured to store a winch line 206 thereon. Drums 204 may be various sizes depending on the machine. Drum 204 on a drum puller 200 configured to pull substantially large loads may be larger than those on a backyard digger derrick configured to pull smaller loads. Winch line 206 may be used to install electrical conductors as described above, or for any other pulling operation. Winch line 206 may comprise material such as synthetic rope, steel cable, or any other rope or steel. In some embodiments, drum puller 200 may be a four drum puller 200, a single drum puller 200, or a two drum puller 200. Broadly, drum puller 200 may comprise any number of drums 204 thereon. Each drum 204 may have an individually controllable winch line 206 stored thereon.

Drums 204 may comprise bearing 208 connected thereto. In some embodiments, bearing 208 is a pillow block bearing or may be any other bearing type encompassing a shaft (not shown) of drum 204. In some embodiments, a bearing 208 is disposed on either side of drum 204 such that drum 204 comprises two bearings 208. In some embodiments, tension measuring system 210 is disposed below bearing 208. In some embodiments, tension measuring system 210 is disposed between supporting structure 211 of drum puller 200 and the winch system (i.e., drum 204 and winch line 206). Tension measuring system 210 may be attached to bearing 208 using bolts, screws, rivets, welds, or any other fastening means. In some embodiments, tension measuring system 210 is disposed below or near supporting structure 211. As discussed further below, tension measuring system 210 may comprise one or more load cells 212 operably connected to drum 204. In some embodiments, tension measuring system 210 is configured to measure the actual tension in winch line 206. Based on the measured tension, a hydraulic pressure may be adjusted to control the tension in winch line 206. Each drum 204 on drum puller 200 may have one or more tension measuring systems 210 attached thereto. Tension measuring system 210 may comprise load cells 212 mounted to a bracket 214 as discussed below with respect to FIG. 2B.

As described above, tension measuring system 210 may be located between the winch system and supporting structure 211. Supporting structure 211 may vary depending on the machine on which the winch system is used. As shown in FIG. 2A, supporting structure 211 may be part of the main frame, such as a crossbar, of drum puller 200. When tension measuring system 210 is used in conjunction with aerial device 100, the supporting structure 211 may comprise a platform bracket (not shown) connected to utility platform 110 and/or upper boom section 108. As discussed below, when tension measuring system is used in conjunction with a digger derrick system 300, supporting structure 211 may comprise a winch mounting bracket on which winch drum 204 and winch line 206 are disposed. Broadly, supporting structure 211 may comprise any structure of the machine on which winch line 206 is disposed that can support tension measuring system 210.

Figure 2B:
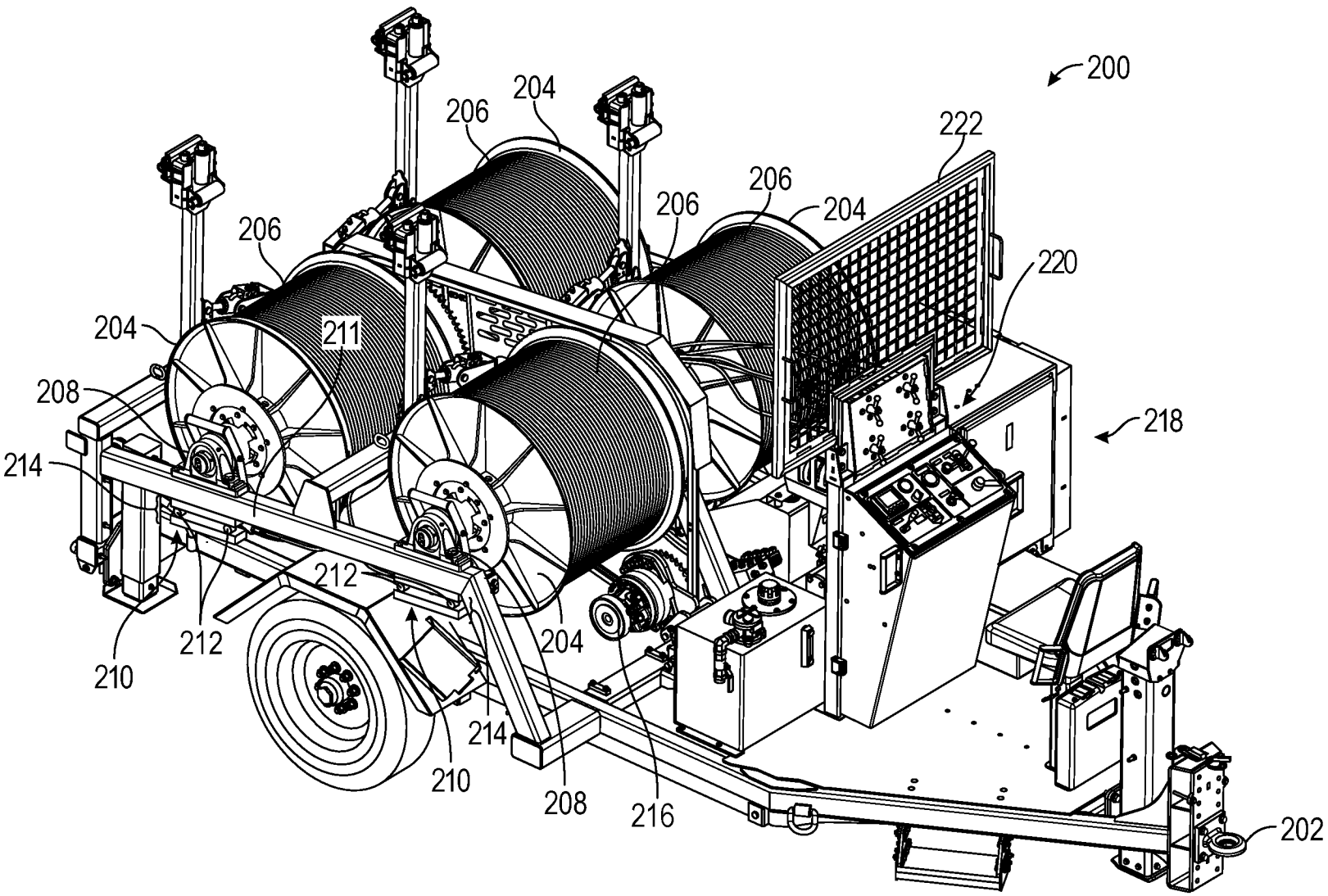
FIG. 2B illustrates a perspective view of the drum puller for some embodiments.

As shown in FIG. 2B, drum puller 200 may further comprise a motor 216. Motor 216 may be electric, gas, hydraulic, pneumatic, or the like. Broadly, any variable motor may be used for embodiments herein. In some embodiments, motor 216 is a hydraulic motor, and the power sent to drums 204 may be varied by regulating the hydraulic pressure entering the hydraulic motor 216. For other motor types, the power sent thereto may be adjusted using appropriate methods. The motor 216 may also be connected to a control system 500 as described below with respect to FIG. 5.

The tension in winch line 206 is a factor of the torque delivered from motor 216 and the radius of drum 204. For traditional winches providing constant torque, because the radius of drum 204 may change during operation as winch line 206 is payed in and out, the tension of winch line 206 may also change. A full drum 204 (as illustrated in FIG. 2B) is a drum 204 in which winch line 206 is entirely wrapped around drum 204 such that drum 204 is at a maximum diameter. A bare drum 204 is a drum 204 in which all of winch line 206 has been payed-out such that drum 204 is at a minimum diameter. When provided constant torque, the tension in winch line 206 will be higher for a bare drum 204 than a full drum 204, as the tension increases with decreasing radius. By regulating the hydraulic pressure for motor 216, the torque delivered to winch line 206 may be varied. Consequently, by adjusting the torque delivered to winch line 206 as the radius of drum 204 changes, the tension in winch line 206 may be held substantially constant. In some embodiments, the maximum tension is set based on a known tension when pulling on a full drum 204.

By providing substantially constant tension in winch line 206, it may be ensured that winch line 206 is not over-tensioned during installation. As described above, pulling systems such as drum puller 200 are often used to install electrical conductor lines in both underground and overhead (e.g., electrical power lines) applications. If the conductor is overstrained during installation, performance of the conductor may be degraded.

An operator controlling drum puller 200 may work in operator station 218. Operator station 218 may comprise various controls 220 such as knobs, levers, switches, buttons, handwheels, and the like for operating drum puller 200. Alternatively, or additionally, an operator may control operations of drum puller 200 remotely, such as via a mobile device. Controls 220 may enable pay-in/pay-out functions for retracting and extending winch line 206. In some embodiments, controls 220 may enable level-wind functioning and/or braking. Operator station 218 may comprise gauges and sensors configured to provide data readouts, such as hydraulic pressure of motor 216. In some embodiments, operator station 218 includes a graphical display 508 (see FIG. 5) on which data for drum puller 200 may be displayed. For example, tension readings from tension measuring system 210 may be displayed on graphical display 508. Use of graphical display 508 may allow an operator to view the tension of winch line 206 substantially in real time such that adjustments can be made on-the-fly if needed. In some embodiments, operator station 218 comprises protective screen 222 to prevent harm to the operator.

Figure 2C:
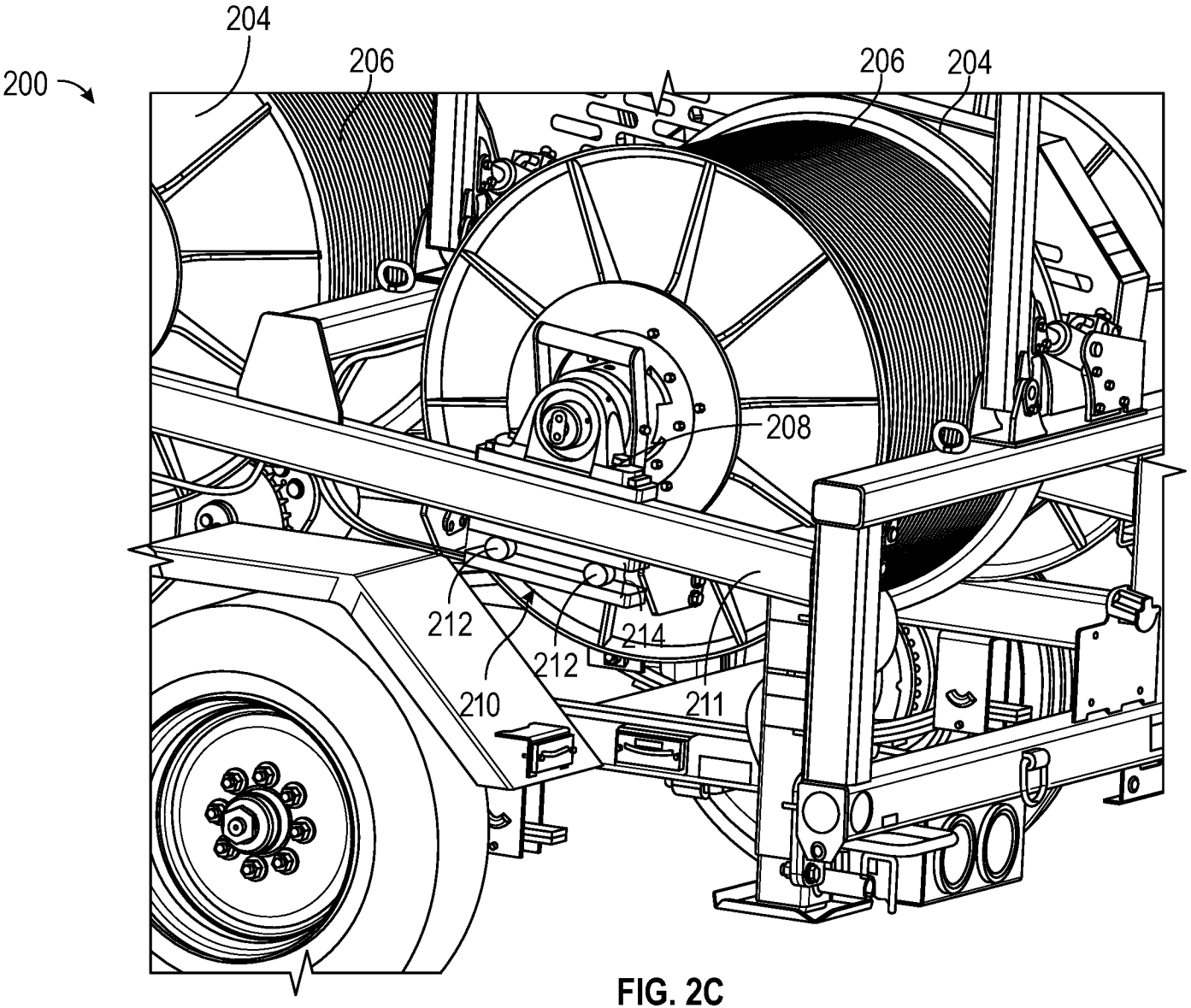
FIG. 2C depicts an enlarged view of a drum of the drum puller for some embodiments.

Looking now at FIG. 2C, a close-up view of a drum 204 on drum puller 200 is illustrated for some embodiments. As previously described, tension measuring system 210 may be disposed below bearing 208 and may be coupled thereto. Alternatively, tension measuring system 210 may abut against bearing 208 without being coupled thereto. In still other embodiments, tension measuring system 210 may be disposed below or adjacent to supporting structure 211. In some embodiments, a gap is present between bearing 208 and tension measuring system 210. In some embodiments, bracket 214 comprises an upper plate and a lower plate with at least one load cell 212 disposed therebetween. While bracket 214 is illustrated having the upper plate and lower plate, it should be understood that bracket 214 may take on various configurations, and the illustrated embodiment is not meant to be limiting. For example, bracket 214 may instead comprise a single plate with load cells 212 integrated therein. Similarly, while load cells 212 are depicted as substantially cylindrical, load cells may be any geometric shape such as square, rectangular, hexagonal, or the like. Broadly, any method of attaching tension measuring system 210 to the winch system such that load cells 212 may measure the deformation caused by the tension in winch line 206 and such that load cells 212 may measure the actual line tension thereof is considered to be within the scope of embodiments herein. When winch line 206 is payed-in or payed-out, bearing 208 may deform. This deformation may result in the deformation of tension measuring system 210. Load cells 212 may then convert the resultant deformation into a measured tension value as discussed further below with respect to FIG. 6.

In some embodiments, tension measuring system 210 comprises one, two or more load cells 212. Additional load cells 212 may be used to improve the accuracy of the tension reading. In some embodiments, tension measuring system 210 comprises a pair of load cells 212. Load cells 212 may comprise a strain gauge thereon configured to deflect when a load is applied as discussed below with respect to FIG. 5. In some embodiments, load cell 212 comprises a semiconductor strain gauge (also referred to as a piezo resistor), a nanoparticle strain gauge, or any other type of load cell or strain gauge. In some embodiments, tension measuring system 210 comprises a summing junction for receiving outputs from load cells 212 and outputting a single load value therefrom.

Load cells 212 may be sized to measure various sized loads depending on the intended use of tension measuring system 210. For example, a typical drum puller 200 may have a maximum line pull of about 2,000 pounds to about 4,000 pounds per drum 204, while a jib winch on utility platform 110 may have a maximum line pull of about 500 pounds to about 2000 pounds. Advantageously, for different use cases, different load cells 212 may be selected and used with tension measuring system 210 based on the expected amount of line pull. As such, load cells 212 used with drum puller 200 may be larger than those used for the jib winch. Similarly, bracket 214 itself may be sized according to the expected tension in winch line 206. For larger load operations, bracket 214 may be increased in size (to accommodate the larger load cells 212), while for smaller load operations (e.g., material handling) bracket 214 may be sized smaller. Additionally, bracket 214 may take on various geometries in order to attach to the requisite aerial device jib winch or other accessories. Bracket 214 may comprise aluminum, alloy steel, stainless steel, or any various other metals or materials with minimal elasticity.

Figure 3:
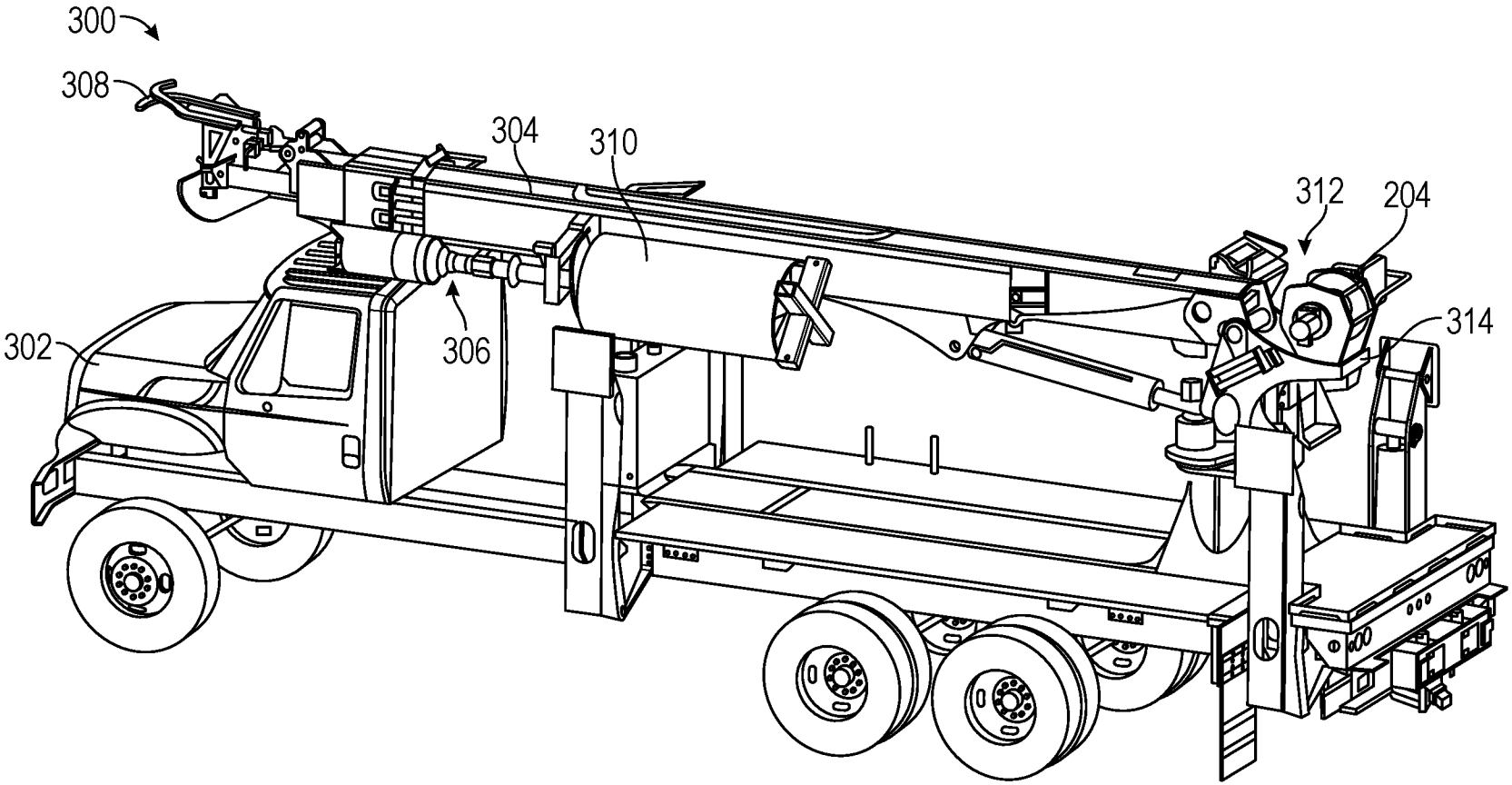
FIG. 3 depicts a digger derrick system for some embodiments.

Turning now to FIG. 3, a digger derrick system 300 is illustrated for some embodiments. Digger derrick system 300 may be a transmission digger derrick configured to install transmission poles. It should be noted that crane systems often comprise winch systems substantially similar to those used in digger derrick systems 300 as discussed below, and embodiments described herein may be employed with cranes and other similar systems. Winch lines 206 on transmission digger derricks are typically configured to pull about 15,000 pounds. Alternatively, digger derrick system 300 may be a backyard digger derrick for working in areas that are difficult to access with conventionally sized machines. Winch lines 206 on backyard digger derricks are typically configured to pull about 3,000 pounds to about 6,000 pounds. Digger derrick system 300 may comprise a utility vehicle 302, a boom 304, and a digger assembly 306. Boom 304 may comprise a proximal end attached to utility vehicle 302 and a distal end supporting a grapple 308 and digger assembly 306. Boom 304 may be one of a telescoping boom or an articulating boom. In some embodiments, grapple 308 is used for grasping objects. Boom 304 may further comprise a hydraulic circuit for transmitting hydraulic power and extending/retracting boom 304. The digger assembly 306 may comprise an auger 310 for digging into the ground or other surface.

Digger derrick system 300 may further comprise winch system 312. Winch system 312 may be connected to and controlled by the hydraulic circuit, which may provide pay-in and pay-out functionality for winch system 312. Winch system 312 may comprise a drum 204 and a winch line 206. In embodiments wherein tension measuring system 210 is used for lighter load applications, such as with digger derrick system 300, drum 204 may be smaller in size and weight than drum 204 on a drum puller 200 as described above. Winch system 312 may be mounted to digger derrick system 300 via winch mounting bracket 314. In some embodiments, winch mounting bracket 314 may function as supporting structure 211 for bracket 214. Tension measuring system 210 may be mounted on a topside, backside, an underside, or a side of winch mounting bracket 314 and operably connected to the winch system 312. Alternatively, or additionally, winch mounting bracket 314 may have tension measuring system 210 integrated therein for measuring tension in winch line 206. In some embodiments, winch mounting bracket 314 functions as bracket 214 and/or supporting structure 211 for tension measuring system 210. The tension measuring system 210 may be connected to control system 500 such that an operator can set a target or maximum winch tension value and control system 500 and, by measuring the actual winch tension in real time using tension measuring system 210, may adjust the motor 216 to hold winch system 312 at or near this tension value. In some embodiments, the maximum winch tension is based on a known tension in winch line 206 when drum 204 is full.

Figure 4:
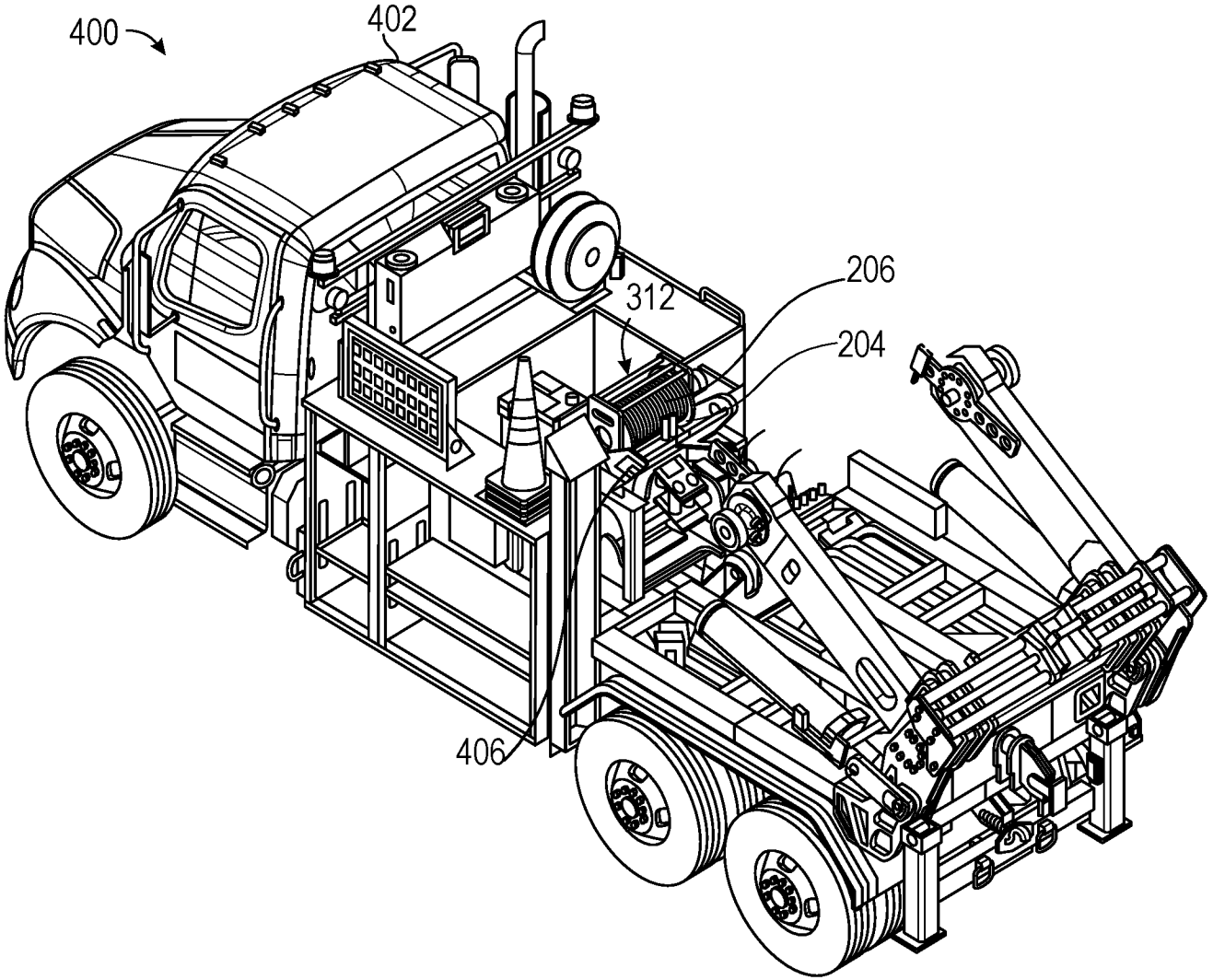
FIG. 4 depicts a bed winch disposed in a truck for some embodiments.

FIG. 4 illustrates a vehicle 400 which, in some embodiments, may be a utility vehicle 402. Vehicle 400 may be a car or truck and may either be manned or unmanned such that vehicle 400 is remotely controlled or autonomous. In some embodiments, vehicle 400 may be a boat for traveling on water.

Vehicle 400 may comprise a winch system 312 disposed thereon. Winch system 312 may be disposed within a bed or on a deck of vehicle 400. As with the above-described drum puller 200, digger derrick system 300, or any other machine having a winch thereon, tension measuring system 210 may be added thereto to measure the tension in winch line 206. As winch line 206 is payed-in and payed-out, tension measuring system 210 may measure the line tension and use the measured line tension to regulate the line tension in winch system 312, log and save the line tension, display the line tension on graphical display 508, or any combination thereof.

Winch system 312 may be mounted to a bed winch mounting bracket 406. Bed winch mounting bracket 406 may be substantially similar to winch mounting bracket 314 described above with respect to digger derrick system 300. Tension measuring system 210 may be coupled to bed winch mounting bracket 406 or integrated therewith to measure the tension in winch line 206 as described in embodiments above.

Figure 5:
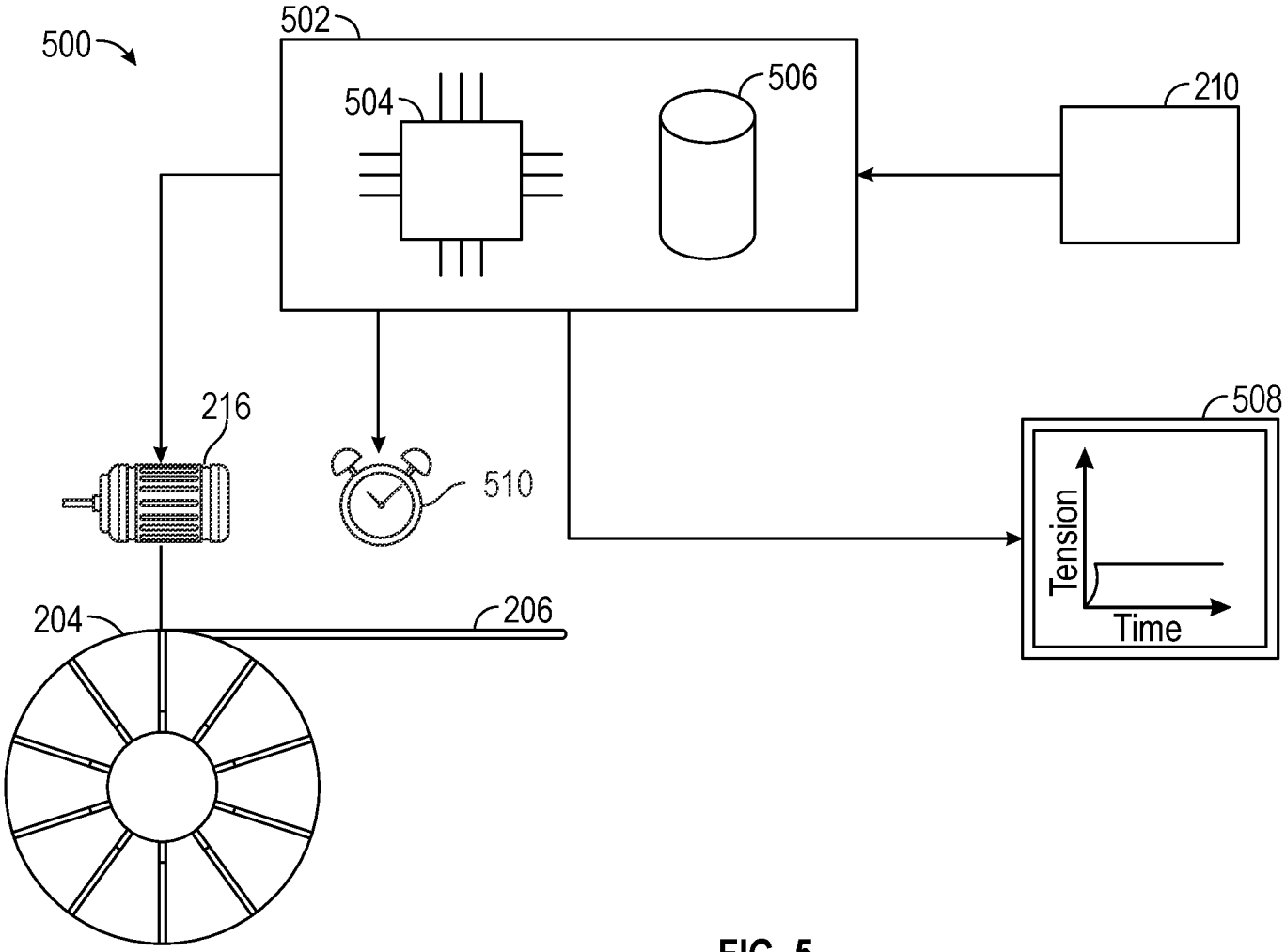
FIG. 5 depicts a control system for some embodiments.

FIG. 5 illustrates a control system 500 for some embodiments. As previously described, by measuring tension of winch line 206 in real time, motor 216 may be adjusted to power winch system 312 to operate at a substantially constant tension. In some embodiments, control system 500 comprises a controller 502, which may be a microcontroller. In some embodiments, controller 502 may be the controller of drum puller 200, aerial device 100, or digger derrick system 300. In some embodiments, controller 502 is configured for remote operations of any of the above-described machines. In some embodiments, controller 502 comprises at least one processing element 504 and at least one storage element 506. In some embodiments, storage element 506 stores computer-readable instructions that may be executed by processing element 504 to control operation of winch system 312 or to perform any other function described herein. For example, regulating pressure to motor 216 may be controlled by the at least one processing element 504 of controller 502.

In some embodiments, controller 502 receives a tension reading from tension measuring system 210. As described above, multiple tension measuring systems 210 may be included, such as for a four drum puller 200 in which each drum 204 may have corresponding tension measuring system 210. As such, multiple tension measuring systems 210 may be communicatively coupled to control system 500. Further, embodiments are contemplated in which other types of sensors may be included within control system 500. For example, a pressure sensor or sensor array may be configured to monitor the pressure of motor 216 and communicatively coupled to control system 500.

In some embodiments, controller 502 is further coupled to motor 216 such that controller 502 is operable to control at least one operation of motor 216 based on a signal indicative of a measurement from tension measuring system 210. For example, a signal may be received by controller 502 from tension measuring system 210 indicative of a measured tension value above the maximum tension value for the operation. Accordingly, controller 502 may transmit a signal to reduce or stop the hydraulic fluid pressure to motor 216 in order to decrease the tension in winch line 206. Motor 216 may be any suitable type of motor operable to rotate drum 204, such as a hydraulic motor, an electric motor, or a pneumatic motor. In some embodiments, motor 216 of winch system 312 is hydraulically driven such that controller 502 may control the motor 216 by adjusting a hydraulic valve (not shown), which may be hydraulically coupled to motor 216. Accordingly, the speed and/or direction of motor 216 may be controlled by adjusting the hydraulic valve. In some embodiments, controller may be used to determine winch line speed.

Controller 502 may also be connected to graphical display 508. As described above, graphical display 508 may be located in operator station 218, at the base of aerial device 100, in the cabin of utility vehicle 302, on a mobile device for remote operations/monitoring, or the like. Graphical display 508 may provide substantially real-time display of operational parameters. For example, graphical display 508 may provide tension values and/or line speed for each winch line 206 on a four drum puller 200. As another example, graphical display 508 may display parameters associated with motor 216, such as motor power or torque. Additionally, graphical display 508 may display visual alerts relating to operations of aerial device 100, winch system 312, or a combination thereof. In some embodiments, graphical display 508 displays a graphical representation of a position of boom assembly 104.

Control system 500 may also comprise an alarm 510 for communicating alerts to operators. Alarm 510 may comprise a visual and/or audible alarm. Alarm may be activated whenever the tension in winch line 206 exceeds a maximum tension, for example. Alarm 510 may audibly alert an operator working in utility vehicle 102 and may also cause the display of a visual alert on graphical display 508.

In some embodiments, data measured during operations of the winch systems 312 and tension measuring system 210 used in drum puller 200 described herein may be logged and stored (e.g., in storage element 506 or stored in the cloud). As one example, tension measurements measured during operations may be logged and stored. As such, evidence of the actual tension experienced by winch line 206 may be obtained. Storing of such data may be advantageous to provide a record for installation operations of conductor, for example. When utility companies contract out electrical installation operations, they often have no way of knowing whether the contractors installed the conductor without over-tensioning the conductor. By logging the tension data during installation, the utility companies may be confident that the conductor was installed properly.

Control system 500 may further control operations of winch system 312 based on a position of boom assembly 104. As described above, the lift capacity of aerial devices 100 are often limited by the position of boom assembly 104 as formed by the boom angle and boom extension length. As upper boom section 108 is extended, the lift capacity that boom assembly 104 is able to support may decrease. As the angle of boom assembly 104 increases (wherein boom assembly 104 is considered to be at 0° when substantially parallel to ground), the lift capacity of boom assembly 104 may increase. Operators are often provided with a load chart depicting the maximum rated lift capacities at various boom positions. If an operator misreads the chart, the aerial device 100 may malfunction, leading to possible equipment damage and/or harm. In some embodiments, control system 500 is configured to determine a target tension value based in part on the operating boom position. For example, the lift capacity of aerial device 100 at its various boom positions may be stored in storage element 506 or a separate database. For a specific boom position, the lift capacity may be retrieved and used as the maximum tension value for winch line 206. If the boom position changes during operation, the maximum tension value may be adjusted accordingly. The boom position may be set by the operator using controls 220 and/or graphical display 508 or detected by various on-board sensors. As such, failures may be prevented because motor 216 can be disabled if the tension in winch line 206 exceeds the lift capacity of aerial device 100 at the specific boom position.

Figure 6:
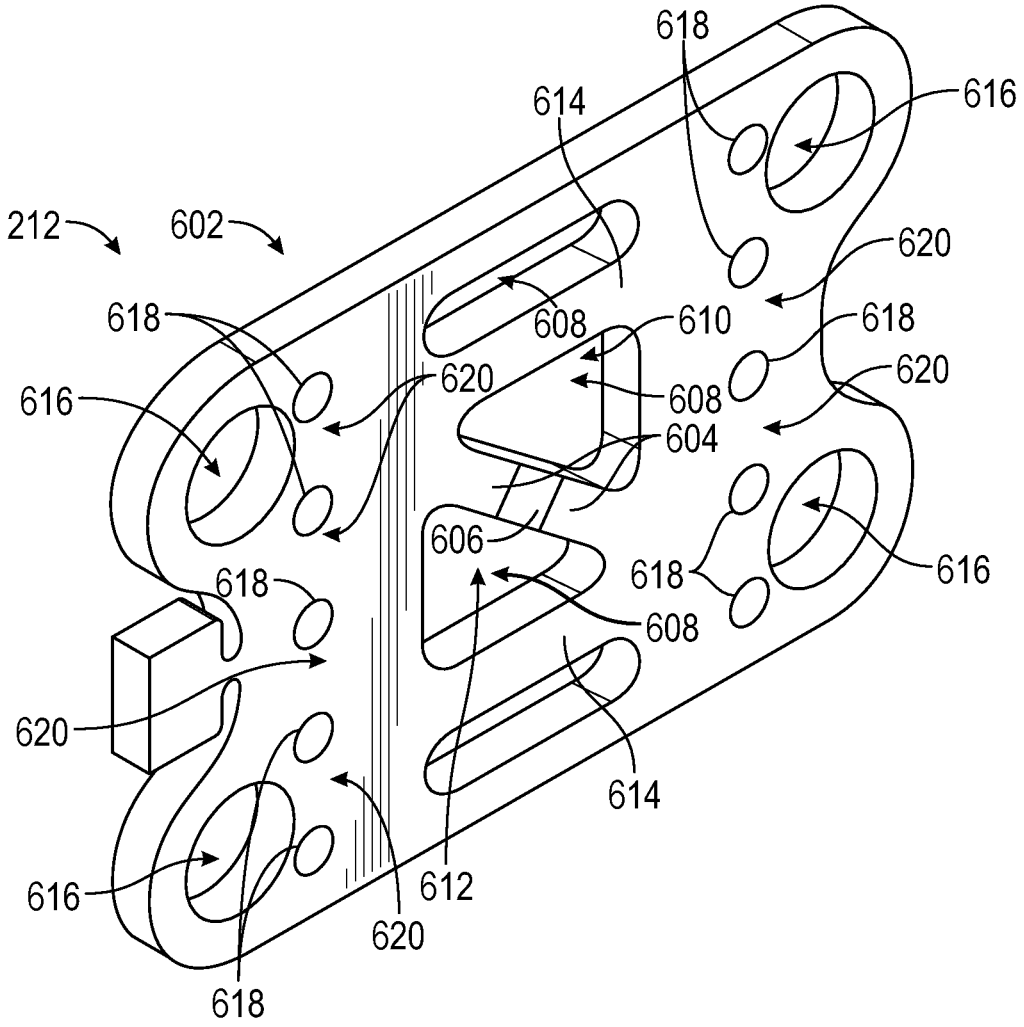
FIG. 6 depicts a load cell for use with the tension measuring system for some embodiments.

FIG. 6 illustrates a subject plate 602 for load cell 212 for some embodiments.

In some embodiments, load cells 212 may be a static strain detection assembly such as described in U.S. Pat. Nos. 9,873,602 and 9,573,797, the entireties of which are hereby incorporated by reference herein. In some embodiments, load cell 212 comprises a subject plate 602, a traversing member 604, and a strain gauge 606. In some embodiments, load cell 212 comprises a plurality of subject plates 602. The strain gauge 606 may provide an indication of the strain upon the traversing member 604, thereby indicating the strain on the subject plate 602 such that the tension in winch line 206 may be determined. Strain gauge 606 may be disposed onto or adjacent traversing member 604. Strain gauge 606 may comprise a metal foil gauge. As traversing member 604 deforms slightly under the strain from the tension in winch line 206, the electrical resistance passing through the metal foil changes due to the change in the geometry. When in tension, the electrical resistance may increase. The measured electrical resistance may be measured either directly at load cell 212 and/or remotely, such as at operator station 218.

Load cell 212 may include non-measured components that support undesired forces (e.g., twisting forces, horizontal forces, moments) and measured components that support the desired forces (e.g., the pulling force of winch line 206). Load cell 212 may be at least partially static, solid, and monolithic, thereby allowing load cell 212 to support the tension in winch line 206 without significantly displacing, changing shape, or moving.

Subject plate 602 may present one or more voids 608 therein. Void 608 may isolate forces such that the forces act on traversing member 604. At least one traversing member 604 may span void 608 as shown, thereby creating a first opening 610 and a second opening 612. Openings 610, 612 may be bisected by traversing member 604 spanning void 608. Openings 610, 612 may be substantially triangular as shown but may take other shapes such as rectangular, square, or circular. Support members 614 may also span void 608 and provide additional structural support for subject plate 602 while allowing subject plate 602 to flex and deform to experience the strain thereon. Support members 614 may support forces that are undesired (e.g., moments, torques) to be experienced by strain gauge 606 such that strain gauge 606 only experiences the load from the tension in winch line 206. Support members 614 may be oriented horizontally (as shown), vertically, or diagonally. Subject plate 602 may also comprise secondary voids 618 which may be circular (as shown) or any other geometric shape. Secondary support members 620 may be disposed between secondary voids 618.

Subject plate 602 may take various sizes, shapes, and orientations for embodiments herein. For example, subject plate 602 may vary when used with a drum puller 200 as compared to when used with digger derrick system 300. Subject plate 602 may attach to load cell 212 via pins, bolts, screws, or the like. In some embodiments, subject plate 602 comprises a hole 616 for receiving a fastener therein.

Figure 7:
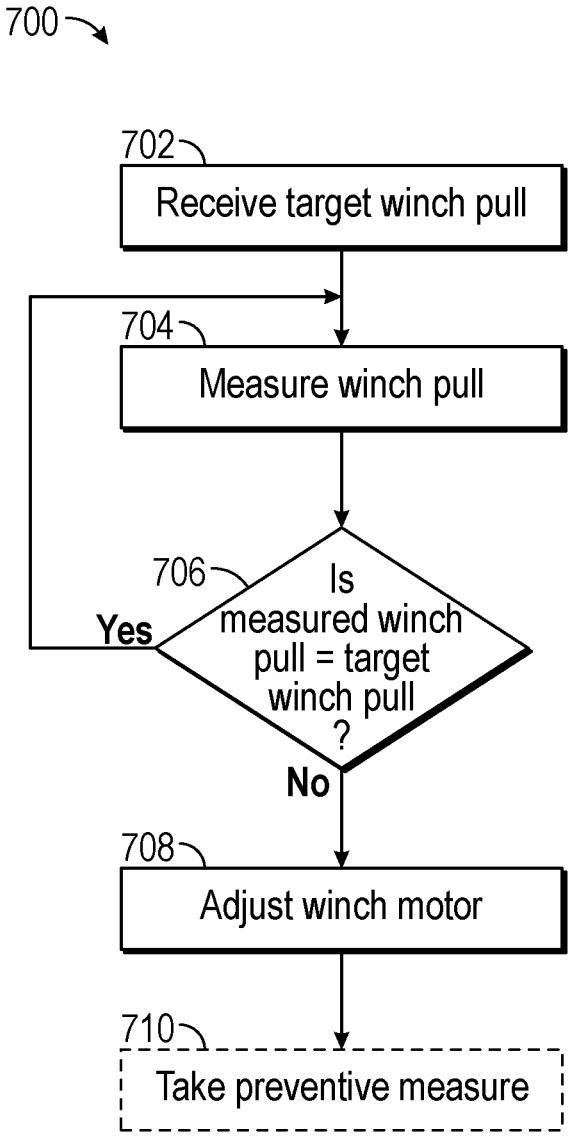
FIG. 7 depicts an exemplary method for regulating winch line pull for some embodiments.

FIG. 7 illustrates an exemplary method 700 relating to some embodiments. In some embodiments, method 700 may describe the operation of controller 502 in conjunction with a winch system 312 on a drum puller 200, a digger derrick system 300, or any other machine. At step 702, a target winch pull value may be received. The target winch pull value may be received from an operator, determined from an operational position, or determined based on a known tension value on a full drum. The target winch pull value may indicate a tension value at which controller 502 should maintain winch line 206 at during operation.

At step 704, line tension in winch line 206 may be measured by tension measuring system 210. Each winch system on the aerial device 100 may be measured with a tension measuring system 210. For example, for each drum 204 on drum puller 200, a tension of the winch line 206 may be measured. Use of tension measuring system 210 may provide the operator substantially real-time tension values of winch line 206.

Processing may then proceed to step 706 whereby it may be determined if the tension measured at step 704 is equivalent to the target tension value determined at step 702. In some embodiments, a tolerance range may be set that must be exceeded before operations are adjusted based on a discrepancy in the measured line tension value and the target line tension value. For example, less than 5% difference between the target winch pull value and the measured winch tension value may be considered to be an equivalent line tension. In some embodiments, the tolerance range is defined by the operator. If the tension values are not substantially equal, processing may proceed to step 706. If the tension values are substantially equal (or within the tolerance range), processing may proceed back to step 704.

At step 708, whereby it has been determined that the measured tension value differs from the target tension value, motor 216 may be adjusted. As described above, adjustment of motor 216 may comprise adjusting a hydraulic valve to increase or decrease the hydraulic fluid pressure supplied to motor 216. If the measured tension value is below the target tension value, the hydraulic fluid pressure may be increased to increase the tension in the winch line 206. If the measured tension value is above the target tension value, the hydraulic fluid pressure may be decreased to decrease the tension in winch line 206.

At optional step 710, any preventive or protective measures may be taken. As previously described, overloading the winch system may lead to operator harm and/or mechanical failure. In some embodiments, an audible and/or visible alarm 510 is actuated when the tension values differ. In some embodiments, operator station 218 further comprises one or more speakers which may be configured to emit an alarm. Similarly, in some embodiments, graphical display 508 may display a visual alarm to alert the operator of the issue. Alternatively, or additionally, operations may be stopped in response to disparate tension measurements. As described above, alerts and various data associated with the winch pull may be logged and stored for future reference.

Although the invention has been described with reference to the embodiments illustrated in the attached drawing figures, it is noted that equivalents may be employed, and substitutions made herein without departing from the scope of the invention as recited in the claims.

Having thus described various embodiments of the invention, what is claimed as new and desired to be protected by Letters Patent includes the following:

1. A method for measuring winch line pull tension for a winch system comprising:
- providing a winch line on a winch drum;
- receiving a target line tension value for the winch line;
- receiving a first tension measurement value of the winch line from a first load cell;
- receiving a second tension measurement value of the winch line from a second load cell,
- wherein the first load cell and the second load cell are mounted on a winch mounting bracket, and the winch mounting bracket is disposed between the winch drum and a supporting structure for the winch drum;
- determining a hydraulic pressure adjustment based on the first tension measurement value, the second tension measurement value, and the target line tension value; and
- responsive to determining the hydraulic pressure adjustment, adjusting a hydraulic pressure for a hydraulic winch motor to adjust a line tension of the winch line.

2. The method of claim 1, wherein the method further comprises displaying the first tension measurement value, the second tension measurement value, or both on a graphical display.

3. The method of claim 1, wherein the winch line and the winch drum are disposed on a boom assembly, and
- wherein the method further comprises:
  - detecting a boom position, the boom position based on a boom angle, a boom extension length, or both; and
  - determining a maximum line tension value based on the boom position.

4. The method of claim 3, wherein the method further comprises:
- responsive to determining the winch line cannot operate at the maximum line tension value based on the boom position, activating an alarm.

5. The method of claim 3, wherein the method further comprises:
- responsive to determining the winch line cannot operate at the maximum line tension value based on the boom position, preventing operation of the hydraulic winch motor.

6. The method of claim 3, wherein the method further comprises:
- detecting a change in the boom position; and
- responsive to detecting the change in the boom position, adjusting the maximum line tension value based on the change in the boom position.

7. The method of claim 1, wherein the method further comprises: responsive to determining one of the first tension measurement value or the second tension measurement value exceeds the target line tension value, activating an alarm.

8. A system for measuring winch line pull tension comprising:
- a winch system comprising at least one winch drum for storing a winch line thereon;
- a hydraulic motor for powering the winch system;
- a mounting bracket disposed between the winch system and a supporting structure for the winch system; and
- at least one tension measuring system on the mounting bracket,
- wherein the at least one tension measuring system is configured to deform during a winch line pull,
- wherein the at least one tension measuring system comprises at least one load cell configured to measure a line tension value in the winch line during use.

9. The system of claim 8, wherein the system further comprises:
- one or more non-transitory computer-readable media storing computer-executable instructions that, when executed by a processor, perform a method for regulating winch line pull tension, comprising:
  - receiving the line tension value from the at least one tension measuring system;
  - comparing the line tension value to a target line tension value; and
  - based on the comparing, adjusting a hydraulic pressure for the hydraulic motor to adjust the line tension on the winch line during use.

10. The system of claim 9,
- wherein the system further comprises a display, and
- wherein the method further comprises:

responsive to receiving the line tension value, displaying the line tension value on the display.

11. The system of claim 9, wherein the winch system is disposed on a distal end of a boom, and wherein the method further comprises:

determining the target line tension value based on a lift capacity of the boom, wherein the lift capacity is based in part on a boom angle and a boom extension length.

12. The system of claim 9, wherein the system further comprises:

an alarm, wherein the alarm is configured to be activated when the measured line tension value is above the target line tension value.

13. The system of claim 8, wherein the winch system is disposed on a drum puller, and wherein the supporting structure comprises a frame of the drum puller.

14. The system of claim 13, wherein the at least one winch drum comprises:

a first winch drum and a second winch drum; and the at least one tension measuring system comprises a first tension measuring system associated with the first winch drum and a second tension measuring system associated with the second winch drum.

15. A system for measuring winch line pull tension comprising:

a winch system, comprising: a winch line and a winch drum for storing the winch line thereon;

a motor for powering the winch system;

a mounting bracket disposed between the winch system and a supporting structure for the winch system;

a tension measuring system operably connected to the winch system and located on the mounting bracket; and one or more non-transitory computer-readable media storing computer-executable instructions that, when executed by a processor, perform a method for regulating winch pull tension comprising:

determining a target tension value for the winch line;

receiving a tension measurement value indicative of a tension in the winch line from the tension measuring system;

comparing the tension measurement value to the target tension value; and based on the comparing, adjusting the motor to regulate the tension in the winch line.

16. The system of claim 15, wherein the system further comprises a database, and wherein the method further comprises:

responsive to receiving the tension measurement value from the tension measuring system, logging the tension measurement value in the database.

17. The system of claim 15, wherein the supporting structure for the winch system is disposed on a digger derrick or a drum puller.

18. The system of claim 15, wherein the tension measuring system comprises a pair of load cells.

19. The system of claim 15, wherein the method further comprises:

if the tension measurement value exceeds the target tension value, disabling the motor.

20. The system of claim 15, wherein the target tension value is determined based on the tension in the winch line when the winch drum is full.

* * * * *